United States Patent [19]

Schöttli

[11] Patent Number: 4,744,479

[45] Date of Patent: May 17, 1988

[54] TAMPER INDICATING CLOSURE FOR BOTTLES AND THE LIKE

[75] Inventor: Theodor Schöttli, Diessenhofen, Switzerland

[73] Assignee: Interplastic AG, Newhausen a. Rhf., Switzerland

[21] Appl. No.: 65,836

[22] Filed: Jun. 23, 1987

[30] Foreign Application Priority Data

Jul. 11, 1986 [CH] Switzerland ..... 2794/86-0

[51] Int. Cl.[4] ..... B65D 41/34

[52] U.S. Cl. ..... 215/252

[58] Field of Search ..... 215/252, 253, 256

[56] References Cited

U.S. PATENT DOCUMENTS

| | | | |
|---|---|---|---|
| 4,305,516 | 12/1981 | Perne et al. | 215/252 |
| 4,372,456 | 2/1983 | Guala | 215/252 |
| 4,527,705 | 7/1985 | Prades | 215/252 |
| 4,530,436 | 7/1985 | Wiedmer | 215/252 X |
| 4,548,329 | 10/1985 | Curry | 215/252 X |
| 4,557,393 | 12/1985 | Boik | 215/253 |
| 4,572,387 | 2/1986 | Luker et al. | 215/252 |

*Primary Examiner*—Stephen Marcus
*Assistant Examiner*—Nova Stucker
*Attorney, Agent, or Firm*—Peter K. Kontler

[57] ABSTRACT

A tamper indicating closure for bottles has a cap with an internally threaded skirt and a cylindrical band which is adjacent the end face of the skirt and has a longer and a shorter arcuate section together forming a ring. The shorter section is attached to the skirt by two relatively strong bridges, and the longer section is attached to the skirt by a readily destructible web midway between its ends and by an elastic neck adjacent one of its ends. The other end of the longer section is attached to the adjacent end of the shorter section by a frangible membrane. When the closure is first applied to the externally threaded neck of a bottle, the two sections remain attached to the skirt and to each other and their internal cams merely ride over a frustoconical bead of the neck to thereupon engage a shoulder of the bead. When the closure is being detached from the neck of the bottle, the bridges entrain the shorter section but the web which connects the longer section to the skirt breaks followed by destruction of the membrane and by initially elastic and thereupon permanent deformation of the neck so that the orientation of the longer section changes drastically as a result of the retaining action of internal cams on the longer section in cooperation with the bead.

24 Claims, 1 Drawing Sheet

FIG. 1
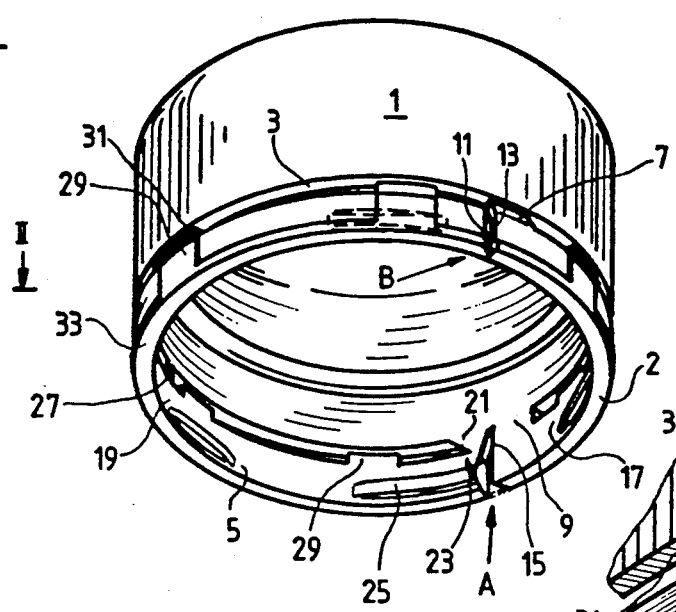
FIG. 4
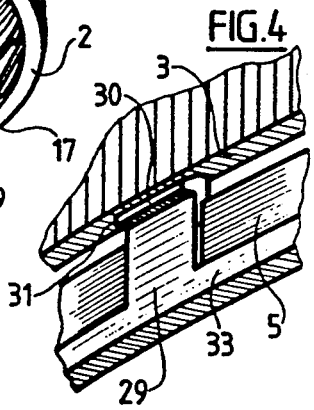
FIG. 2
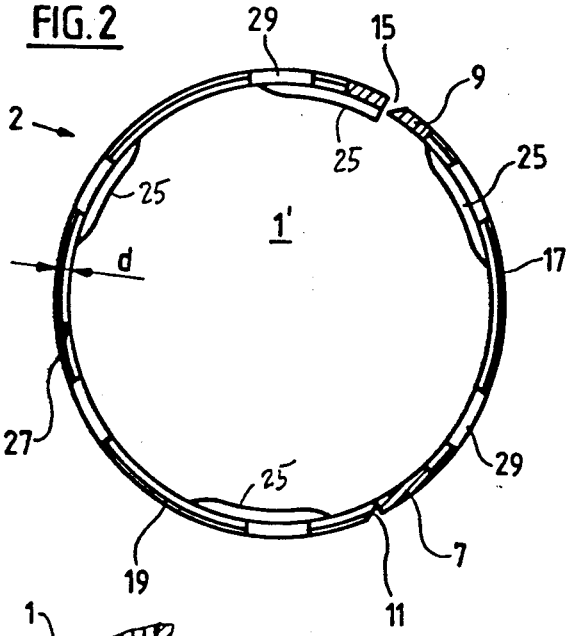
FIG. 3
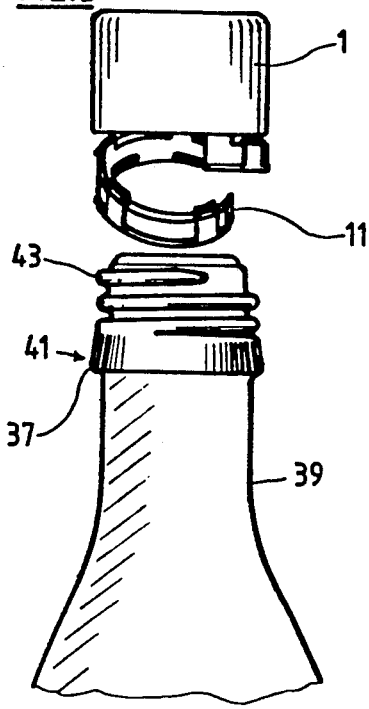
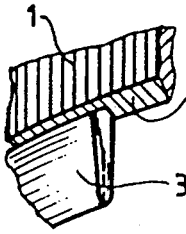
FIG. 5

TAMPER INDICATING CLOSURE FOR BOTTLES AND THE LIKE

BACKGROUND OF THE INVENTION

The invention relates to closures for bottles and other types of containers in general, and more particularly to improvements in closures with tamper indicating devices in the form of bands or rings which are used on filled containers to facilitate immediate determination of the condition of the container, namely whether or not the contents of the container are intact and are still packaged in a manner as provided for by the manufacturer.

Closures with tamper indicating bands are often made of thermoplastic material and are used on many types of bottles or other threaded-neck containers in order to enable a potential purchaser or user to rapidly and reliably ascertain whether or not the container was tampered with subsequent to original filling and sealing. The purpose of such bands or rings is to ensure that their condition changes so drastically in response to first opening of the container (i.e., in response to partial or complete removal of the closure) that this fact cannot be concealed even from a casual observer.

The majority of heretofore known tamper indicating devices constitute or resemble bands which are connected to the skirts of the respective bottle caps or like closures by a plurality of narrow bridges or webs. The inner and outer diameters of the band normally match or closely approximate the respective diameters of the skirt of the cap. When the cap is properly applied to the neck of a bottle or another threaded-neck container (e.g., in that its internal threads mate with the external threads on the neck), the band is heated and shrunk onto the adjacent portion of the neck beneath the thread so that it closely hugs the external surface of the neck and the bridges or webs are caused to break when the cap is unscrewed. In order to further reduce the likelihood of separation of the band jointly with the cap, the neck of the bottle is normally provided with a larger-diameter bead beneath the external thread and the band is shrunk onto and extends beyond the bead in a direction away from the thread so as to invariably ensure reliable destruction of the bridges in response to unscrewing of the cap. In other words, when the cap is detached, the band remains on the neck of the bottle.

A drawback of the just described tamper indicating devices is that the band can be expanded in response to heating or that its flexibility greatly increases in response to heating so that it can be detached with the cap and, if desired, reapplied and shrunk back onto the bead. In fact, even body heat often suffices to soften the band if the latter is held in hand for a sufficient interval of time. Another drawback of such bands is that they normally remain on the necks of the containers so that, if the containers are to be recycled, it is necessary to remove the bands from the necks in a separate time-consuming operation which precedes the refilling and the application of a fresh (intact) closure.

French Pat. No. 2 454 977 to Perne et al. discloses a modified tamper indicating band which breaks in response to detachment of the closure from a container and remains attached to the skirt of the closure. Several separable sections of the band are connected to each other by weakened portions (also called rupture sites) which are easy to break and are supposed to break when the closure is detached from the container. A drawback of the patented closure is that the band tends to break in response to the very first application of the closure so that the damaged or destroyed band creates the impression of previous tampering with the container even though the contents of the container are still intact.

OBJECTS AND SUMMARY OF THE INVENTION

An object of the invention is to provide a closure for bottles or other types of sealable containers which is provided with a novel and improved tamper indicating device and whose tamper indicating device is constructed, configurated and applied to the main portion of the closure in such a way that it does not undergo damage during first application to the open end of a filled container but is invariably affected by first detachment of the closure to such an extent that actual or attempted tampering with the contents of the container cannot be concealed even to a casual observer.

Another object of the invention is to provide a novel and improved band-like tamper indicating device which can be applied to internally threaded caps for bottles or other types of containers in such a way that proper application of the device to the container does not require any heating and subsequent mechanical deformation or thermally induced shrinkage of the device around the bead on the neck of a bottle or the like.

A further object of the invention is to provide a closure wherein the band-like tamper indicating device is constructed in such a way that it continues to form part of the detached closure so that the container can be recycled without incurring additional costs for separation of the tamper indicating device therefrom.

An additional object of the invention is to provide a closure whose tamper indicating device can readily stand the first application but is invariably and visibly affected by first detachment of the closure from a container.

Still another object of the invention is to provide a closure which embodies the above outlined tamper indicating device and can be used in connection with standard bottles and analogous containers.

The invention is embodied in a tamper indicating closure for application to containers, particularly in an internally threaded cap for application to the externally threaded neck of a bottle, vial or the like. The closure comprises a tubular member (such tubular member can constitute the skirt of a customary screw cap) having an open end, and a tamper indicating band which is adjacent the open end, which is substantially concentric with the tubular member and which includes a relatively long and a relatively short arcuate section. The band further comprises weakened portions which constitute rupture or separation sites between the longer and shorter sections and at least one bridge connecting at least one of the sections to the tubular member. At least one of the weakened portions can have a slot between the arcuate sections, i.e., the respective ends of the sections are then completely separated from each other.

The band is preferably provided with a plurality of bridges which connect the one section (normally the shorter section) with the tubular member, and the band further comprises an elastic neck which connects the other section with the tubular member. At least one of the bridges is or can be frangible. Alternatively, at least one of the bridges can be designed to establish a rigid and normally inseparable connection between the one section and the tubular member (the term "inseparable" is intended to denote that the respective bridge or bridges are expected to stand those breaking or tearing forces which are anticipated in normal use of the closure).

One of the weakened portions can include a thin web between the sections of the band and the other weakened portion can have the aforementioned slot. As a rule, the two sections together extend along an arc of 360 degrees. The band can comprise first and second bridges which connect the circumferentially spaced apart end portions of the one section to the tubular member. As mentioned above, at least one of the bridges can be frangible or at least one of the bridges can be designed to establish a substantially inseparable connection between the one section and the tubular member.

Each section can be provided with an elongated arcuate abutment which is adjacent the end face at the open end of the tubular member and actually contacts the end face during application of the closure to the open end of a bottle, vial or a like container. The abutments can have enlarged heads which are adjacent the end face of the tubular member and such enlarged heads can be provided with facets which are parallel to or inclined relative to the end face of the tubular member. Alternatively, each section can have a composite abutment including a set of circumferentially spaced-apart protuberances which are adjacent and are movable relative to the end face of the tubular member. Each protuberance can have a facet which is parallel or inclined with reference to the end face and such facet or facets can be provided on enlarged portions or heads of the protuberances.

At least one of the sections can be provided with an arcuate reinforcing rib, preferably in that region which is remotest from the end face of the tubular member.

The band can comprise a frangible bridge in the form of a thin and readily breakable web which connects the other (normally the longer) section of the band to the tubular member. The internal surface of the band can be provided with at least one cam-like projection which preferably extends in the circumferential direction of the band and can engage a complementary projection (e.g., an annular bead) at the exterior of the container to which the closure is applied. The projection of the band is preferably adjacent one of the weakened portions and is preferably offset with reference to the aforementioned frangible web in the circumferential direction of the band to thus ensure that the web breaks while the internal projection of the band engages the external projection of the container and while the closure is caused to move axially away from the projection on the container.

The novel features which are considered as characteristic of the invention are set forth in particular in the appended claims. The improved closure itself, however, both as to its construction and the mode of applying and detaching the same, together with additional features and advantages thereof, will be best understood upon perusal of the following detailed description of certain specific embodiments with reference to the accompanying drawing.

BRIEF DESCRIPTION OF THE DRAWING

FIG. 1 is an enlarged perspective view of a closure for bottles which embodies one form of the invention and shows the tamper indicating band in undeformed condition with the integrity of its bridges, neck, webs and weakened portions intact;

FIG. 2 is an end elevational view of the band and a sectional view of the bridges between the band sections and the tubular member as seen in the direction of arrows from the line II—II of FIG. 1;

FIG. 3 is a fragmentary elevational view of the neck of a bottle and an elevational view of the closure with its band distorted and partially separated from the tubular member;

FIG. 4 is an enlarged perspective view of a detail in the closure of FIG. 4, showing a protuberance which is provided on one of the band sections adjacent the end face of the tubular member; and FIG. 5 is a fragmentary perspective view of a modification wherein at least one band section has an elongated arcuate abutment in lieu of several protuberances of the type shown in FIG. 4.

DESCRIPTION OF THE PREFERRED EMBODIMENTS

FIG. 1 shows a closure which is made of thermoplastic material and embodies one form of the invention. The closure comprises an internally threaded tubular member or skirt 1 one end of which is closed by an end wall 1' and the other end of which is open and is surrounded by a ring-shaped end face 3. The open end of the tubular member 1 is adjacent a tamper indicating band 2 which is constructed, configurated and connected with the member 1 in accordance with the invention. The manner in which the interior of the tubular member 1 is provided with or supports a sealing pad or the like to ensure proper sealing engagement with the neck 39 of a bottle (shown in FIG. 3) or an analogous threaded-neck container forms no part of the invention.

The tamper indicating band 2 comprises a preferably cylindrical body 5 having a longer arcuate section 19 and a shorter arcuate section 17. When the band 2 is intact, the sections 17, 19 are substantially or exactly coplanar with the tubular member 1, i.e., their external surfaces need not project radially outwardly beyond the external surface of the member 1. The two end portions of the shorter arcuate section 17 are integrally connected with the adjacent portions of the tubular member 1 by two bridges 7 and 9 which can be frangible or sufficiently rigid and stable to ensure that the section 17 is more or less permanently (inseparably) connected with the member 1 (except, of course, if a rather large force is applied on purpose to break the bridges 7 and 9 so that the section 17 becomes completely separated from the tubular member 1).

The band 2 further comprises a weakened portion or rupture site B which is provided between neighboring end portions of the sections 17, 19 and is formed as a result of the provision of an axially parallel notch 11 in the external surface of the band 2 so that the respective end portions of the sections 17, 19 are connected to each other by a relatively thin web or membrane of plastic material between the deepmost portion of the notch 11 and the internal surface of the band. The membrane or web at the bottom of the notch 11 can be extremely thin (i.e., as thin as possible without unduly complicating the making of the closure). The two surfaces 13 flanking the notch 11 can make an acute angle (this can be readily seen in FIG. 1 and particularly in FIG. 2).

The distance between the bridges 7 and 9 (as seen in the circumferential direction of the band 2) is less than 180 degrees.

A second weakened portion A of the band 2 includes a substantially axially parallel slot 15, i.e., the respective end portions of the arcuate sections 17, 19 are completely separated from each other as can be readily seen in FIG. 2 which further shows that the slot 15 is bounded by two mutually inclined surfaces making an acute angle so that the width of the slot 15 increases in a direction from the internal toward the external surface of the band 2. If desired or necessary, the weakened portion A can also include a thin or extremely thin web (indicated in FIG. 1 by broken lines) which is adjacent the internal or the external surface of the band 2 and extends across the slot 15 (which is then converted into a notch because it does not extend all the way between the internal and external surfaces of the band). The web across the deepmost or outermost portion of the slot 15 can be provided for optical reasons, i.e., to make the band 2 appear as constituting a circumferentially complete body. The strength of the just discussed web is preferably negligible, i.e., it will be destroyed in response to the application of a relatively small force which tends to pull or push the adjacent end portion of the arcuate section 19 axially and/or radially of the tubular member 1.

The longer arcuate section 19 of the band 2 is integrally connected with the tubular member 1 by an elastic neck 21 which is adjacent the weakened portion A and is a relatively narrow and rather thin piece of plastic material at one side of the slot 15 opposite the bridge 9. A circumferentially extending recess or notch 23 is provided between the section 19 and the end face 3 in the region of the weakened portion A to determine the thickness or width of the neck 21 so that the elasticity of the neck will suffice to allow for a twisting and/or other movements of the section 19 with reference to the tubular member 1 without necessarily breaking the connection (note the orientation of the longer arcuate section 19 in FIG. 3).

The internal surface of the arcuate section 19 is provided with a circumferentially extending projection 25 in the form of an elongated cam one end of which is or can be close or immediately adjacent the slot 15 (i.e., the weakened portion A). The internal surface of the projection 25 extends substantially tangentially of the band 2. Another projection or cam 25 is provided on the internal surface of the arcuate section 19 closely or immediately adjacent the weakened portion B, i.e., adjacent the notch 11. At least one additional projection or cam 25 can be provided at the inner side of the section 19 intermediate its ends, i.e., midway or somewhere between the projections 25 which are adjacent the weakened portions A and B. The internal surface of the section 19 can be provided with three, four or more equidistant or otherwise distributed projections 25. As can be seen in FIG. 2, the internal surface of the shorter arcuate section 17 is also provided with a projection or cam 25 which is adjacent the weakened portion A (slot 15). One or more additional projections 25 can be provided at the inner side of the section 17 without departing from the spirit of the invention.

The connection between the longer arcuate section 19 and the tubular member 1 includes the aforementioned elastically deformable neck 21 as well as a thin and readily breakable (frangible) bridge or web 27 which is located midway or substantially midway between the weakened portions A and B. FIG. 1 shows that the web 27 is very narrow (it can be said to resemble a thread) and extends in substantial parallelism with the common axis of the tubular member 1 and ring 2. If desired or necessary, the connection between the arcuate section 19 and the tubular member 1 can comprise two or more frangible webs 27 each of which can be destroyed with the exercise of a small or very small effort. The illustrated web 27 is offset with reference to the nearest projections 25 of the section 19 in the circumferential direction of the band 2, i.e., there is no projection 25 immediately adjacent the web 27 because such projection could cause a premature destruction of the web during application of the closure to the neck 39 of the bottle. As shown in FIG. 2, the web 27 is located between but is spaced apart from each of two nearest projections 25 at the inner side of the arcuate section 19.

In order to adequately prop the sections 17, 19 of the band 2 against excessive axial movement toward the edge face 3 of the tubular member 1, the band further comprises circumferentially spaced apart protuberances 29 (see also FIG. 4) each of which has an enlarged portion or head 30 adjacent the end face 3. The protuberances 29 are not integral with the tubular member 1, i.e., they can move radially of the adjacent portion of the end face 3 and can move away from the end face in response to destruction of connections between the member 1 and the respective sections 17, 19. Those facets of the protuberances 29 which are adjacent the tubular member 1 can actually abut the end face 3 or they can be closely adjacent thereto when the band 2 is still intact. As shown in FIG. 4, each protuberance 29 can have a facet which is parallel to the adjacent portion of the end face 3 and a facet 31 which is inclined with reference to the end face 3. The head 30 enlarges the area of contact between the respective protuberance 29 and the adjacent portion of the end face 3 if a positive engagement (surface-to-surface contact) between the protuberance and the member 1 is necessary in order to maintain the respective arcuate section in proper position with reference to the end face 3.

The band 2 is or can be provided with a circumferentially extending reinforcing rib 33 which is remote from the end face 3 of the tubular member 1 and opposes unintentional twisting and/or other deformation of the arcuate section 17 or 19 with reference to the section 19 or 17 and/or member 1. The reinforcing rib 33 is preferably interrupted at 15 and is preferably weakened at 11 so as to allow for an angular and/or other displacement of the section 19 relative to the section 17 and tubular member 1 with the exertion of a small effort.

The exact ratio of the circumferential lengths of the sections 17, 19 is not critical. It is preferred to provide a band 2 whose section 19 is noticeably longer than the section 17 (FIG. 2 shows that the section 17 extends along an arc of approximately 120 degrees, i.e., its length is substantially half the length of the section 19). FIG. 2 further shows that the thickness of the web 27 is a small fraction of the thickness d of the section 19 (for example, the thickness of the web 27 can between 10 and 50 percent of the thickness d). Still further, FIG. 2 shows that the ends of the circumferentially extending projections 25 need not merge gradually into the internal surfaces of the respective sections 17 and 19.

FIG. 5 shows that the set of circumferentially spaced apart protuberances 29 on the sections 17 and 19 can be replaced with a continuous ring-shaped abutment 30' which has an enlarged head adjacent to or in actual abutment with the end face 3 of the tubular member 1. That portion of the arcuate abutment 30' which is adjacent the end face 3 can have a facet which is parallel to the end face and/or a facet which is inclined with reference to the end face 3. The abutment 30′ need not have a head which is as pronounced as the head 30 of the protuberance 29 shown in FIG. 4 because the abutment 30′ is sufficiently resistant to deformation due to its mass. As shown in FIG. 5 by broken line, at least one side (e.g., the outer side) of the abutment 30′ need not constitute or resemble a cylindrical surface but can have a concave shape. It is also possible to provide the abutment with an internal and/or external surface which is frustoconical or is composed of two frustoconical sections one of which tapers toward and the other of which tapers away from the end face 3 of the tubular member 1.

The mode of applying the band 2 to the neck 39 of a bottle and of thereupon destroying or sufficiently distorting the band as a result of rotation of the closure with reference to the bottle will be described with reference to FIG. 3 which shows that the neck 39 has an open end adjacent an external thread 43 located outwardly of a circumferentially complete frustoconical collar or bead 41 having a radially extending shoulder 37 facing away from the thread 43. The bottle can be made of a vitreous or other material, and the closure including the tubular member 1 and the band 2 can be applied in a conventional bottle capping machine of any known design.

While the tubular member 1 is being threaded onto the neck 39 of the bottle, the orientation of the shorter arcuate section 17 with reference to the tubular member 1 remains substantially unchanged because the bridges 7 and 9 are sufficiently stiff to withstand the developing deforming stresses, if any. However, the longer arcuate section 19 is urged radially outwardly by the external thread 43 or at least by the bead 41 so that the width of the slot 15 is likely to increase. However, the forces acting upon the section 19 during threading of the closure onto the neck 39 of the bottle do not suffice to break or permanently deform the elastic neck 21 and/or the very thin web 27 between the section 19 and the tubular member 1. The thin web adjacent the deepmost portion of the notch 11 enables the section 19 to change its orientation with reference to the section 17 without breaking during application of the closure. During such application of the closure, the cam-like projections 25 (if there are any such projections at all) at the inner sides of the sections 17, 19 ride first over or beneath the external thread 43 and thereupon along the tapering peripheral surface of the bead 41 to ultimately snap behind the shoulder 37 as soon as the sealing of the neck 39 of the bottle is completed, i.e., as soon as the end wall 1′ of the tubular member 1 or a sealing pad at the inner side of such end wall sealingly engages the open end of the bottle. Thus, the projections 25 then cooperate with the shoulder 37 of the bead 41 to oppose movements of the sections 17, 19 toward the open end of the bottle. The shoulder 37 is or can be located in a plane which extends at right angles to the axis of the neck 39 and its thread 43. It is to be noted that, during threading of the closure onto the neck 39, the protuberances 29 or the arcuate abutment 30′ will be in actual contact with the end face 3 of the tubular member 1 so as to ensure a highly predictable advancement of the band 2 toward and along the bead 41.

If a person thereupon decides to remove the closure, the tubular member 1 is rotated in a direction to move upwardly, as seen in FIG. 3, whereby the projections 25 bear against the shoulder 37 of the bead 41. That projection 25 which is located behind the web 27 (as seen in the direction of rotation of the closure to detach the tubular member 1 from the bottle) opposes any movement of the web 27 with the tubular member 1 toward the position of the tubular member in FIG. 3 so that the web 27 is destroyed and the neck 21 then constitutes the sole connection between the section 19 and the member 1. The connection between the sections 17, 19 is established by way of the web adjacent the deepmost portion of the notch 11, and such web breaks in response to further axial movement of the tubular member 1 in a direction away from the bead 41 because the projections 25 at the inner side of the section 19 continue to abut the shoulder 37. At any rate, the weakened portion B yields not later than when the tubular member 1 is completely detached from the neck 39. The neck 21 remains intact because it is elastic and acts not unlike a hinge which enables the section 19 to pivot with reference to the tubular member 1. The elasticity of the material of the neck 21 can be readily selected in such a way that the neck undergoes permanent (plastic) deformation not later than when the separation of the tubular member 1 from the neck 39 of the bottle is completed so that the orientation of the twisted and/or otherwise deformed and/or reoriented section 19 is readily detectable with the naked eye and this informs the person holding the closure that the band 2 is no longer intact. Moreover, at least some permanant deformation of the neck 21 is normally desirable and advantageous because it prevents an uhauthorized person from attempting to move the parts 1, 17 and 19 back to the positions they assume upon first application of the closure to the bottle, i.e., prior to deformation and partial destruction of the band 2. If the tubular member 1 is to be reapplied in order to reseal a partially emptied bottle, the person manipulating the closure may decide to break off the section 19 and/or 17 and to reapply only the tubular member.

An advantage of the improved closure is that it need not be heated and/or otherwise treated preparatory to or subsequent to attachment to the open end of a container. Thus, the band 2 can be properly applied to the container without undergoing even partial destruction provided that it is applied for the first time. However, once the tubular member 1 has been moved axially toward or all the way to the position of FIG. 3 in which it is detached from the neck 39 of the bottle, the condition of the band 2 is clearly indicative that the closure has been detached from the container and the initial condition of the band 2 cannot be reestablished because the web 27 is destroyed, the web adjacent the deepmost portion of the notch 11 is also destroyed and the neck 21 has undergone permanent deformation.

Another advantage of the improved closure is that mere heating of the band 2 while the closure is properly applied to the container will not enable a person to detach the tubular member 1 without destroying the web 27 and the web adjacent the deepmost portion of the notch 11 and/or without permanently deforming the neck 21.

A further important advantage of the improved closure is that the sections 17, 19 of the band 2 are separated from the container in response to detachment of the tubular member 1 so that it is not necessary to remove the remnants of the band in a separate operation if the container is to be reused i.e., refilled with a liquid or other flowable material preparatory to the application of a new closure.

An additional important advantage of the improved closure is that the band 2 can be formed jointly with the cap proper (i.e., with the skirt 1 and end wall 1') and that the band can be applied to the neck of a bottle or the like in a conventional bottle capping machine. The elasticity of the bridges 7, 9 and neck 21 can be readily selected in such a way that these parts are not destroyed during first application of the closure, even if the band and/or the cap is mass-produced within wide tolerances from an optimum size and shape. On the other hand, partial separation of the section 19 from the tubular member 1 invariably takes place in several stages when the person holding the bottle decides to unscrew the closure. The first stage involves a destruction of the frangible web 27, and the second stage involves a destruction of the web adjacent the deepmost portion of the notch 11. This second stage or a further stage involves or can involve permanent deformation of the neck 21 so that the longer section 19 assumes the position which is shown in FIG. 3 and is clearly indicative that the closure was removed, at least once, i.e., that the condition of the container is not the same as immediately after coming from the bottling plant. Still further, and as mentioned above, deformation of the neck 21 is preferably permanent so that even a highly skilled or patient person is unlikely to restore the condition of the band 2 to an extent which is necessary to mislead an observer into the belief that the closure was not as yet detached from the bottle.

The web 27 invariably breaks in response to unscrewing of the tubular member 1 because the arcuate section 19 is longer than the section 17, because the web 27 is preferably very weak, and also because the web 27 is remote from the neck 21 which acts not unlike a hinge when the member 1 is caused to move axially and away from the bead 41 whose shoulder 37 holds the projections 25 at the inner side of the section 19. The bridges 7, 9 are sufficiently strong and exhibit a requisite amount of elasticity to enable the section 17 to share the axial movement of the tubular member 1 from its sealing position toward the position of FIG. 3.

Without further analysis, the foregoing will so fully reveal the gist of the present invention that others can, by applying current knowledge, readily adapt it for various applications without omitting features that, from the standpoint or prior art, fairly constitute essential characteristics of the generic and specific aspects of my contribution to the art and, therefore, such adaptations should and are intended to be comprehended within the meaning and range of equivalence of the appended claims.

I claim:

1. A tamper indicating closure for application to containers, particularly an internally threaded cap for application to the externally threaded necks of bottles, comprising a tubular member having an open end; and a tamper indicating band adjacent said open end, said band being substantially concentric with said member and including a relatively long and a relatively short arcuate section, weakened portions constituting rupture sites intermediate said sections, and at least one bridge connecting at least one of said sections with said member.

2. The closure of claim 1, wherein at least one of said weakened portions has a slot between said sections.

3. The closure of claim 1, wherein said band has a plurality of bridges which connect said one section with said member, said band further having an elastic neck connecting the other of said sections with said member.

4. The closure of claim 3, wherein at least one of said bridges is frangible.

5. The closure of claim 3, wherein at least one of said bridges is arranged to establish a rigid and inseparable connection between said one section and said member.

6. The closure of claim 3, wherein one of said weakened portions includes a thin web between said sections and the other of said weakened portions has a slot between said sections.

7. The closure of claim 1, wherein said one section has first and second end portions which are spaced apart from each other in the circumferential direction of said band, said band having first and second bridges which respectively connect said first and second end portions with said member.

8. The closure of claim 7, wherein at least one of said bridges is frangible.

9. The closure of claim 7, wherein at least one of said bridges is arranged to establish a rigid and inseparable connection between said one section and said member.

10. The closure of claim 1, wherein said member has an end face and at least one of said sections has an elongated arcuate abutment adjacent and movable relative to said end face.

11. The closure of claim 10, wherein the abutment has an enlarged head adjacent said end face.

12. The closure of claim 11, wherein said head has a facet adjacent and substantially parallel to said end face.

13. The closure of claim 11, wherein said abutment has a facet adjacent and inclined with reference to said end face.

14. The closure of claim 1, wherein said member has an end face and at least one of said sections has at least one protuberance adjacent and movable relative to said end face.

15. The closure of claim 14, wherein said protuberance has a facet adjacent and parallel to said end face.

16. The closure of claim 14, wherein said protuberance has a facet adjacent and inclined with reference to said end face.

17. The closure of claim 1, wherein at least one of said sections has an arcuate reinforcing rib.

18. The closure of claim 1, wherein said band comprises at least one bridge connecting one of said sections to said member and a frangible bridge connecting the other of said sections with said member.

19. The closure of claim 18, wherein said frangible bridge includes a thin web of plastic material which is integral with said other section and said member.

20. The closure of claim 1, wherein said band has an internal surface with at least one projection which is engageable with a complementary projection of the container to which the closure is applied.

21. The closure of claim 20, wherein the projection of said band extends in the circumferential direction of the band.

22. The closure of claim 20, wherein the projection of said band is adjacent one of said weakened portions.

23. The closure of claim 22, wherein the projection of said band is provided on the other of said sections.

24. The closure of claim 20, wherein said band comprises at least one first bridge connecting said one section with said member and a frangible bridge connecting said member with the other of said sections, said frangible bridge being offset with reference to the projection of said band in the circumferential direction of the band.

* * * * *